US009639024B2

(12) United States Patent
Tauchi et al.

(10) Patent No.: US 9,639,024 B2
(45) Date of Patent: May 2, 2017

(54) DEVELOPING DEVICE AND IMAGE FORMING APPARATUS INCLUDING SAME

(71) Applicant: KYOCERA Document Solutions Inc., Osaka (JP)

(72) Inventors: Yasuhiro Tauchi, Osaka (JP); Yukari Ota, Osaka (JP); Shinji Otani, Osaka (JP); Takashi Somete, Osaka (JP); Yoshimi Shimizu, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/227,540

(22) Filed: Aug. 3, 2016

(65) Prior Publication Data

US 2017/0075254 A1 Mar. 16, 2017

(30) Foreign Application Priority Data

Sep. 14, 2015 (JP) ..... 2015-180491

(51) Int. Cl.
*G03G 15/09* (2006.01)
*G03G 15/08* (2006.01)

(52) U.S. Cl.
CPC ..... *G03G 15/0812* (2013.01); *G03G 15/0815* (2013.01); *G03G 15/09* (2013.01)

(58) Field of Classification Search
CPC ..... G03G 15/0812; G03G 15/0815; G03G 15/0887; G03G 15/09
See application file for complete search history.

(56) References Cited

U.S. PATENT DOCUMENTS

2012/0201575 A1 8/2012 Kashimoto et al. ..... 399/272
2013/0209142 A1* 8/2013 Kusukawa ..... G03G 15/081 399/274
2014/0205310 A1* 7/2014 Ohashi ..... G03G 15/0812 399/98

FOREIGN PATENT DOCUMENTS

JP 2012-208469 A 10/2012
JP 2012-6411 A 1/2014

* cited by examiner

*Primary Examiner* — Hoang Ngo
(74) *Attorney, Agent, or Firm* — Stein IP, LLC

(57) ABSTRACT

A developing device of the present disclosure includes a developing roller, a toner supplying roller, a regulation blade, a casing, a toner receiver support member, a toner receiver member, and a vibration generator. The toner receiver support member is disposed inside the casing so as to face the developing roller or the toner supplying roller between the regulation blade and an image carrier. The toner receiver member is disposed along a longitudinal direction of the toner receiver support member, and has a toner receiving surface that receives toner falling from the developing roller. The vibration generator vibrates the toner receiver member. At each end part of the toner receiving surface in its longitudinal direction, there is formed a thin-walled portion that is thinner in thickness than other parts of the toner receiving surface.

11 Claims, 11 Drawing Sheets

DEVELOPING DEVICE AND IMAGE FORMING APPARATUS INCLUDING SAME

INCORPORATION BY REFERENCE

This application is based upon and claims the benefit of priority from the corresponding Japanese Patent Application No. 2015-180491 filed on Sep. 14, 2015, the entire contents of which are incorporated herein by reference.

BACKGROUND

The present disclosure relates to a developing device that supplies developer to an image carrier and an electro-photographic image forming apparatus including the developing device.

In an electro-photographic image forming apparatus, an electrostatic latent image is formed by irradiating a circumferential surface of an image carrier (a photosensitive drum) with light based on information of an image read from a document image or based on information of an image transmitted from an external device such as a computer or the like. Toner is supplied from a developing device to the electrostatic latent image to form a toner image, which is then transferred onto a sheet. The sheet that has gone through the transfer process is then subjected to toner-image fixing processing, and discharged to outside.

In recent years, more and more complicated configurations have come to be adopted in image forming apparatuses along with progress in color printing and high-speed processing. In addition, for higher-speed processing, it is indispensable to achieve higher-speed rotation of a toner stirring member within the developing device. In particular, according to a development method in which a two-component developer containing magnetic carrier and toner is used, and in which a magnetic roller (a toner supplying roller) that carries the developer and a developing roller that carries only the toner are used, in an opposing portion where the developing roller and the magnetic roller face each other, a magnetic brush is formed on the magnetic roller, and by the magnetic brush, only the toner is carried on the developing roller, and further, the toner left unused for development is peeled off from the developing roller. This is liable to cause toner particles to float in the vicinity of the opposing portion where the developing roller and the magnetic roller face each other, and such floating toner particles accumulate around a trimming blade (a regulation blade). If the accumulated toner particles adhere to the developing roller in a condensed manner, they may eventually fall and cause an image defect.

As a solution to such a problem, for example, there is known a developing device in which a two-component developer containing magnetic carrier and toner is used, in which a magnetic roller that carries the developer and a developing roller that carries only the toner are used, and that further includes a toner receiver support member that faces the developing or magnetic roller, a toner receiver member that is disposed along a longitudinal direction of the toner receiver support member and receives toner fallen from the developing roller, and vibration generating means that vibrates the toner receiver member.

There is also known a developing device in which a sheet-shaped vibration adjusting member is disposed at both end parts of a toner receiver support member in its longitudinal direction to be spaced by a predetermined distance from a toner receiver member. In this developing device, when the toner receiver member vibrates, the toner receiver member comes into contact with the vibration adjusting member, whereby the toner receiver member is caused to vibrate in waves such that a free end of the toner receiver member moves warping in an arc, and thereby, toner accumulated on a free-end side of the toner receiver member is moved to a fulcrum side.

SUMMARY

According to an aspect of the present disclosure, a developing device includes a developing roller, a toner supplying roller, a regulation blade, a casing, a toner receiver support member, a toner receiver member, and a vibration generator. The developing roller is disposed to face an image carrier on which an electrostatic latent image is formed, and the developing roller is configured to supply toner to the image carrier in an opposing region where the developing roller and the image carrier face each other. The toner supplying roller is disposed to face the developing roller, and the toner supplying roller is configured to supply toner to the developing roller in an opposing region where the toner supplying roller and the developing roller face each other. The regulation blade is disposed to face the toner supplying roller with a predetermined space therebetween. The casing accommodates the developing roller, the toner supplying roller, and the regulation blade. The toner receiver support member is disposed inside the casing so as to face the developing roller or the toner supplying roller between the regulation blade and the image carrier. The toner receiver member is disposed along a longitudinal direction of the toner receiver support member, and has a toner receiving surface that receives toner falling from the developing roller. The vibration generator vibrates the toner receiver member. At each end part of the toner receiving surface in a longitudinal direction thereof, a thin-walled portion is formed that is thinner in thickness than other parts of the toner receiving surface.

Further features and specific advantages of the present disclosure will become apparent from the following descriptions of preferred embodiments.

DETAILED DESCRIPTION

Figure 1:
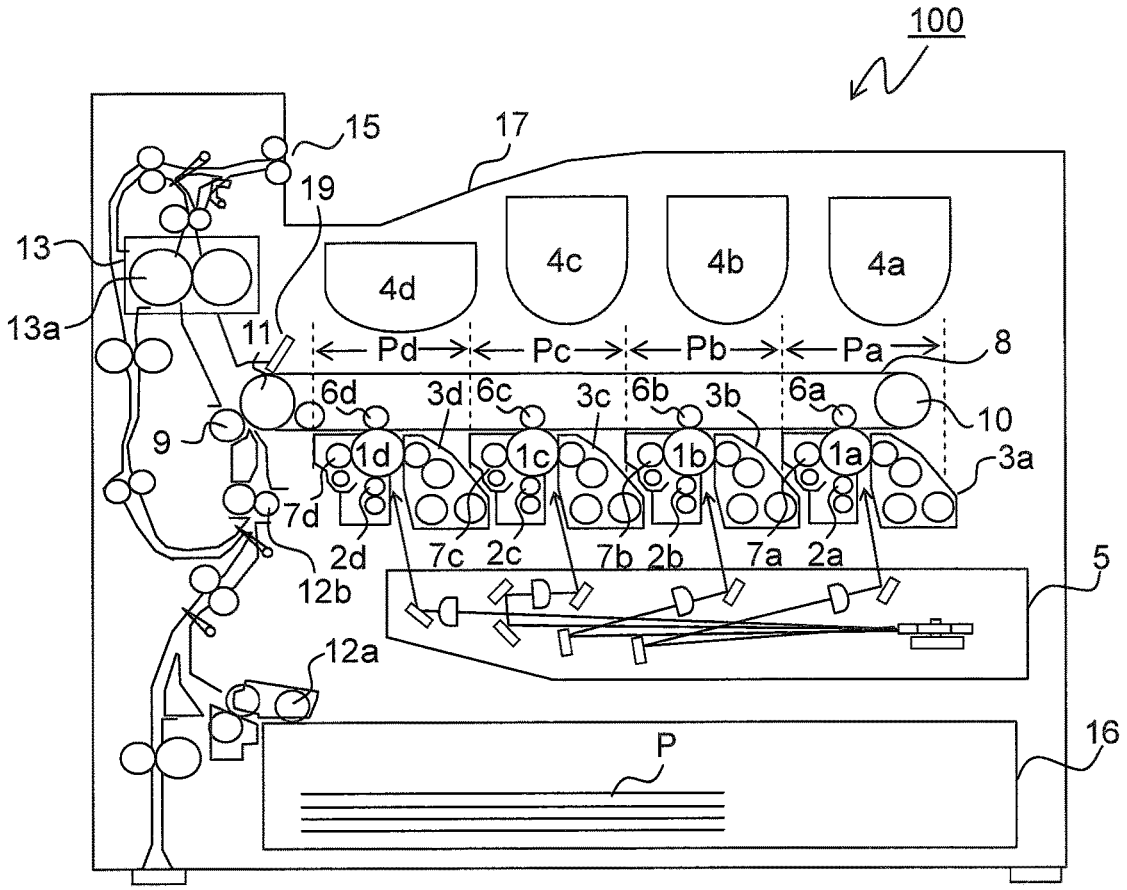
FIG. 1 is a schematic configuration diagram illustrating an image forming apparatus 100 including developing devices 3*a* to 3*d* of the present disclosure.

Hereinafter, embodiments of the present disclosure will be described with reference to the accompanying drawings. FIG. 1 is a schematic sectional view of an image forming apparatus incorporating developing devices 3*a* to 3*d* of the present disclosure, and the image forming apparatus shown herein is a tandem-type color printer. In a main body of a color printer 100, four image forming portions Pa, Pb, Pc, and Pd are arranged in this order from an upstream side in a conveyance direction (a right side in FIG. 1). The image forming portions Pa to Pd are provided corresponding to images of four different colors (cyan, magenta, yellow, and black), and sequentially form images of cyan, magenta, yellow, and black through charging, exposure, developing, and transferring steps.

In the image forming portions Pa, Pb, Pc, and Pd, there are disposed photosensitive drums 1*a*, 1*b*, 1*c*, and 1*d*, respectively, each for carrying a visible image (toner image) of a corresponding color, and further, an intermediate transfer belt 8 that is rotated by driving means (not shown) in a clockwise direction in FIG. 1 is disposed adjacent to the image forming portions Pa to Pd. The toner images formed on the photosensitive drums 1*a* to 1*d* are primarily transferred sequentially onto the intermediate transfer belt 8, which moves in contact with the photosensitive drums 1*a* to 1*d*, and the toner images are superimposed one on another on the intermediate transfer belt 8. Then, the toner images primarily transferred onto the intermediate transfer belt 8 are secondarily transferred onto a transfer paper sheet P as an example of a recording medium by operation of a secondary transfer roller 9. Further, the transfer paper sheet P onto which the toner images have been secondarily transferred is discharged from a main body of the color printer 100 after the toner images are fixed thereon at a fixing portion 13. An image forming process is performed with respect to the photosensitive drums 1*a* to 1*d* while rotating the photosensitive drums 1*a* to 1*d* in a counterclockwise direction in FIG. 1.

Transfer paper sheets P onto each of which a toner image is to be secondarily transferred are accommodated in a sheet cassette 16 disposed in a lower part of the color printer 100. A transfer paper sheet P is conveyed via a sheet feeding roller 12*a* and a registration roller pair 12*b* to a nip portion between the secondary transfer roller 9 and a later-described driving roller 11 provided for driving the intermediate transfer belt 8. The intermediate transfer belt 8 is made of a dielectric resin sheet, and mainly formed as a (seamless) belt having no seam. Furthermore, for the purpose of removing toner and the like remaining on a surface of the intermediate transfer belt 8, a blade-shaped belt cleaner 19 is disposed downstream of the secondary transfer roller 9.

Next, the image forming portions Pa to Pd will be described. Provided around and below the rotatablly disposed photosensitive drums 1*a*, 1*b*, 1*c*, and 1*d* are chargers 2*a*, 2*b*, 2*c*, and 2*d* that charge the photosensitive drums 1*a*, 1*b*, 1*c*, and 1*d*, respectively, an exposure device 5 that exposes the photosensitive drums 1*a* to 1*d* with light based on image information, developing devices 3*a*, 3*b*, 3*c*, and 3*d* that form a toner image on the photosensitive drums 1*a*, 1*b*, 1*c*, and 1*d*, respectively, and cleaning portions 7*a*, 7*b*, 7*c*, and 7*d* that remove residual developer (toner) and the like remaining on the photosensitive drums 1*a*, 1*b*, 1*c*, and 1*d*, respectively.

When image data is input from a host device such as a personal computer, the chargers 2*a* to 2*d* first charge surfaces of the photosensitive drums 1*a* to 1*d* uniformly. Then, the exposure device 5 irradiates the photosensitive drums 1*a* to 1*d* with light according to the image data, and thereby an electrostatic latent image is formed on each of the photosensitive drums 1*a* to 1*d* according to the image data. The developing devices 3*a* to 3*d* are each filled with a predetermined amount of two-component developer containing cyan, magenta, yellow, or black toner. Note that the developing devices 3*a* to 3*d* are replenished with toner from toner containers 4*a* to 4*d* when the proportion of toner contained in the two-component developer in each of the developing devices 3*a* to 3*d* falls below a regulation value after formation of toner images, which will be described below. The toner contained in the developer is supplied onto the photosensitive drums 1*a* to 1*d* by the developing devices 3*a* to 3*d*, respectively, and electrostatically adheres thereto, whereby toner images are formed according to the electrostatic latent images that have been formed by being exposed to light from the exposure device 5.

Further, by primary transfer rollers 6*a* to 6*d*, an electric field is applied at a predetermined transfer voltage between the primary transfer rollers 6*a*, 6*b*, 6*c*, and 6*d* and the photosensitive drums 1*a*. 1*b*, 1*c*, and 1*d*, respectively, and the toner images of cyan, magenta, yellow, and black on the photosensitive drums 1*a* to 1*d* are primarily transferred onto the intermediate transfer belt 8. The toner images of the four colors are formed with a predetermined positional relationship therebetween that is previously determined for forming a predetermined full-color image. Thereafter, in preparation for formation of new electrostatic latent images to be subsequently performed, toner and the like remaining on the surfaces of the photosensitive drums 1*a* to 1*d* are removed by the cleaning devices 7*a* to 7*d*.

The intermediate transfer belt 8 is wound around and between a driven roller 10 disposed on an upstream side and a driving roller 11 disposed on a downstream side. When the intermediate transfer belt 8 starts to rotate in the clockwise direction along with rotation of the driving roller 11 caused by a driving motor (not shown), the transfer paper sheet P is conveyed from the registration roller pair 12*b* at a predetermined timing to a nip portion (a secondary transfer nip portion) between the driving roller 11 and the secondary transfer roller 9 disposed adjacent to the driving roller 11. Then, the full color image on the intermediate transfer belt 8 is secondarily transferred onto the transfer paper sheet P. The transfer paper sheet P onto which the toner image has been transferred is then conveyed to the fixing portion 13.

The transfer paper sheet P that has been conveyed to the fixing portion 13 is heated and pressurized by a fixing roller pair 13*a*, whereby the toner image is fixed on a surface of the transfer paper sheet P, and thus a predetermined full-color image is formed. The transfer paper sheet P on which the full-color image has been formed is discharged onto a discharge tray 17 by a discharge roller pair 15.

Figure 2:
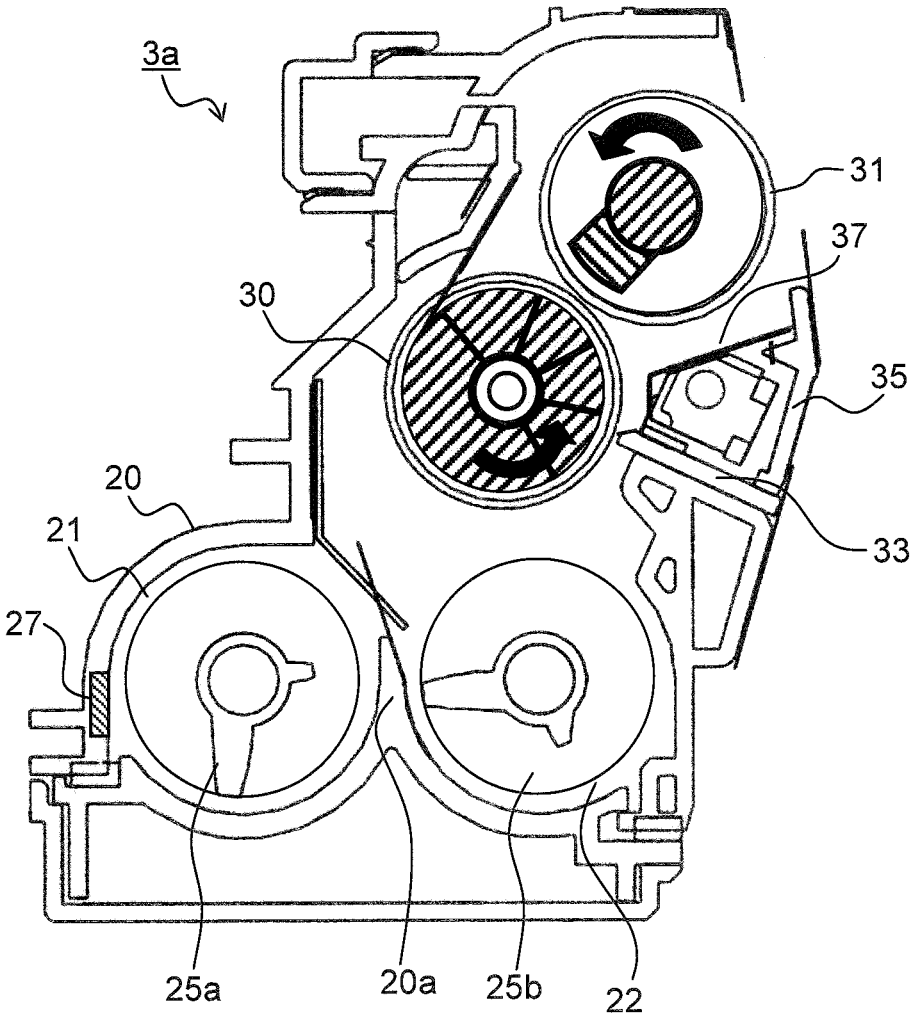
FIG. 2 is a side sectional view of the developing device 3*a* according to an embodiment of the present disclosure.

FIG. 2 is a side sectional view of a developing device 3*a* according to an embodiment of the present disclosure. Note that FIG. 2 illustrates a state in which the developing device 3*a* is seen from a back side of FIG. 1, and arrangement of components in the developing device 3*a* appears to be left-right reversal to that illustrated in FIG. 1. Further, in the following description, only the developing device 3*a* arranged in the image forming portion Pa of FIG. 1 will be dealt with as an example, and the developing devices 3*b* to 3*d* arranged in the image forming portions Pb to Pd are not described. This is because each of the developing devices 3*b* to 3*d* has basically the same structure as that of the developing device 3*a*.

As illustrated in FIG. 2, the developing device 3*a* includes a developing container (a casing) 20 for storing a two-component developer (hereinafter, simply referred to as developer) composed of toner and magnetic carrier. The developing container 20 is partitioned by a partition wall 20*a* into a stirring-conveyance chamber 21 and a supply-conveyance chamber 22. In the stirring-conveyance chamber 21 and the supply-conveyance chamber 22, there are rotatably disposed a stirring-conveyance screw 25*a* and a supply-conveyance screw 25*b*, respectively, for mixing and stirring toner (positively charged toner) supplied from the toner container 4*a* (see FIG. 1) with carrier to charge the toner.

Then the developer is conveyed in an axial direction (a direction perpendicular to a surface of a sheet on which FIG. 2 is drawn) while being stirred by the stirring-conveyance screw 25*a* and the supply-conveyance screw 25*b*, and circulates between the stirring-conveyance chamber 21 and the supply-conveyance chamber 22 through a developer passage (not shown) formed at each end part of the partition wall 20*a*. That is, inside the developing container 20, a developer circulation path is formed with the stirring-conveyance chamber 21, the supply-conveyance chamber 22, and the developer passages.

The developing container 20 extends obliquely right upward in FIG. 2. In the developing container 20, a toner supplying roller 30 (a developer carrier) is arranged above the supply-conveyance screw 25*b*, and a developing roller 31 is arranged obliquely right above the toner supplying roller 30 so as to face the toner supplying roller 30. The developing roller 31 faces the photosensitive drum 1*a* (see FIG. 1) on an opening side of the developing container 20 (right side in FIG. 2). The toner supplying roller 30 and the developing roller 31 are rotated in the counterclockwise direction in FIG. 2 about rotation shafts thereof.

In the stirring-conveyance chamber 21, a toner concentration detection sensor 27 is disposed to face the stirring-conveyance screw 25*a*. The toner concentration detection sensor 27 detects a toner-to-carrier ratio (T/C) in the developer. Based on a detection result obtained by the toner concentration detection sensor 27, toner is replenished from the toner container 4*a* to the stirring-conveyance chamber 21 via an unillustrated toner replenishment port. Used as the toner concentration detection sensor 27 is, for example, a magnetic permeability sensor that detects magnetic permeability of the developer in the developing container 20.

The toner supplying roller 30 is composed of a non-magnetic rotary sleeve that rotates in the counterclockwise direction in FIG. 2, and a stationary magnet body having a plurality of magnetic poles enclosed in the rotary sleeve.

The developing roller 31 is composed of a cylindrical developing sleeve that rotates in the counterclockwise direction in FIG. 2, and a developing-roller-side magnetic pole fixed in the developing sleeve. The toner supplying roller 30 and the developing roller 31 face each other with a predetermined gap therebetween at a facing position (an opposing position). The developing-roller-side magnetic pole has a polarity reverse to that of such one (a main pole) of the magnetic poles of the stationary magnet body as faces the developing-roller-side magnetic pole.

Further, the developing container 20 is provided with a trimming blade 33 attached thereto along a longitudinal direction of the toner supplying roller 30 (a direction perpendicular to the surface of the sheet on which FIG. 2 is drawn). The trimming blade 33 is positioned on an upstream side relative to the opposing position of the developing roller 31 and the toner supplying roller 30, in a rotational direction of the toner supplying roller 30 (the counterclockwise direction in FIG. 2). A slight clearance (gap) is provided between an edge of the trimming blade 33 and a surface of the toner supplying roller 30.

A direct-current voltage (hereinafter, referred to as Vslv(DC)) and an alternating-current voltage (hereinafter, referred to as Vslv(AC)) are applied to the developing roller 31. A direct-current voltage (hereinafter, referred to as Vmag(DC)) and an alternating-current voltage (hereinafter, referred to as Vmag(AC)) are applied to the toner supplying roller 30. These direct-current voltages and alternating-current voltages are applied to the developing roller 31 and the toner supplying roller 30 from a developing bias power source via a bias control circuit (neither of which is shown).

As described above, the developer circulates in the stirring-conveyance chamber 21 and the supply-conveyance chamber 22 in the developing container 20 while being stirred by the stirring-conveyance screw 25*a* and the supply-conveyance screw 25*b* to thereby charge the toner contained in the developer, and then the developer is conveyed from the supply-conveyance chamber 22 to the toner supplying roller 30 by the supply-conveyance screw 25*b*. Then, a magnetic brush (not shown) is formed on the toner supplying roller 30, the magnetic brush is regulated in layer thickness by the trimming blade 33, and is then conveyed to the opposing portion of the toner supplying roller 30 and the developing roller 31. In this manner, a thin layer of toner is formed on the developing roller 31 by making use of a potential difference ΔV between Vmag(DC) to be applied to the toner supplying roller 30 and Vslv(DC) to be applied to the developing roller 31, and a magnetic field.

A thickness of the toner layer formed on the developing roller 31 depends on factors such as resistance of the developer and difference in rotation speed between the toner supplying roller 30 and the developing roller 31, but the thickness of the toner layer is controllable by means of ΔV. A larger ΔV increases, and a smaller ΔV reduces, the thickness of the toner layer on the developing roller 31. An appropriate range of ΔV at the time of development is generally a range of from approximately 100 V to 350 V.

The thin layer of toner formed on the developing roller 31 through contact with the magnetic brush formed on the toner supplying roller 30 is transported by the rotation of the developing roller 31 to an opposing portion (an opposing region) where the photosensitive drum 1*a* and the developing roller 31 face each other. Since Vslv(DC) and Vslv(AC) are applied to the developing roller 31, potential difference between the developing roller 31 and the photosensitive drum 1*a* causes toner to fly from the developing roller 31 to the photosensitive drum 1*a*, and the electrostatic latent image on the photosensitive drum 1*a* is developed with the toner.

Toner left without being used for development is conveyed back to the opposing portion of the developing roller 31 and the toner supplying roller 30, and is collected by the magnetic brush formed on the toner supplying roller 30. Next, the magnetic brush is peeled off from the toner supplying roller 30 at a homopolar portion of the stationary magnet body, and then falls into the supply-conveyance chamber 22.

After that, based on a detection result obtained by the toner concentration detection sensor 27, a predetermined amount of toner is replenished via the toner replenishment port (not shown), and circulates in the supply-conveyance chamber 22 and the stirring-conveyance chamber 21, whereby the two-component developer is restored to an appropriate toner concentration, and uniformly charged. This developer is supplied again onto the toner supplying roller 30 by the supply-conveyance screw 25*b* to form a magnetic brush, and conveyed to the trimming blade 33.

In the vicinity of the developing roller 31 on a right side wall of the developing container 20 in FIG. 2, there is provided a toner receiver support member 35 that has a triangular shape in section and projects to an inside of the developing container 20. As illustrated in FIG. 2, the toner receiver support member 35 is disposed along a longitudinal direction of the developing container 20 (a direction perpendicular to the surface of the sheet on which FIG. 2 is drawn). An upper surface of the toner receiver support member 35 forms a wall portion facing the toner supplying roller 30 and the developing roller 31 and inclined downward in a direction of from the developing roller 31 to the toner supplying roller 30. To the upper surface of the toner receiver support member 35, along its longitudinal direction, there is attached a toner receiver member 37 that receives toner peeled off and fallen from the developing roller 31.

Figure 3:
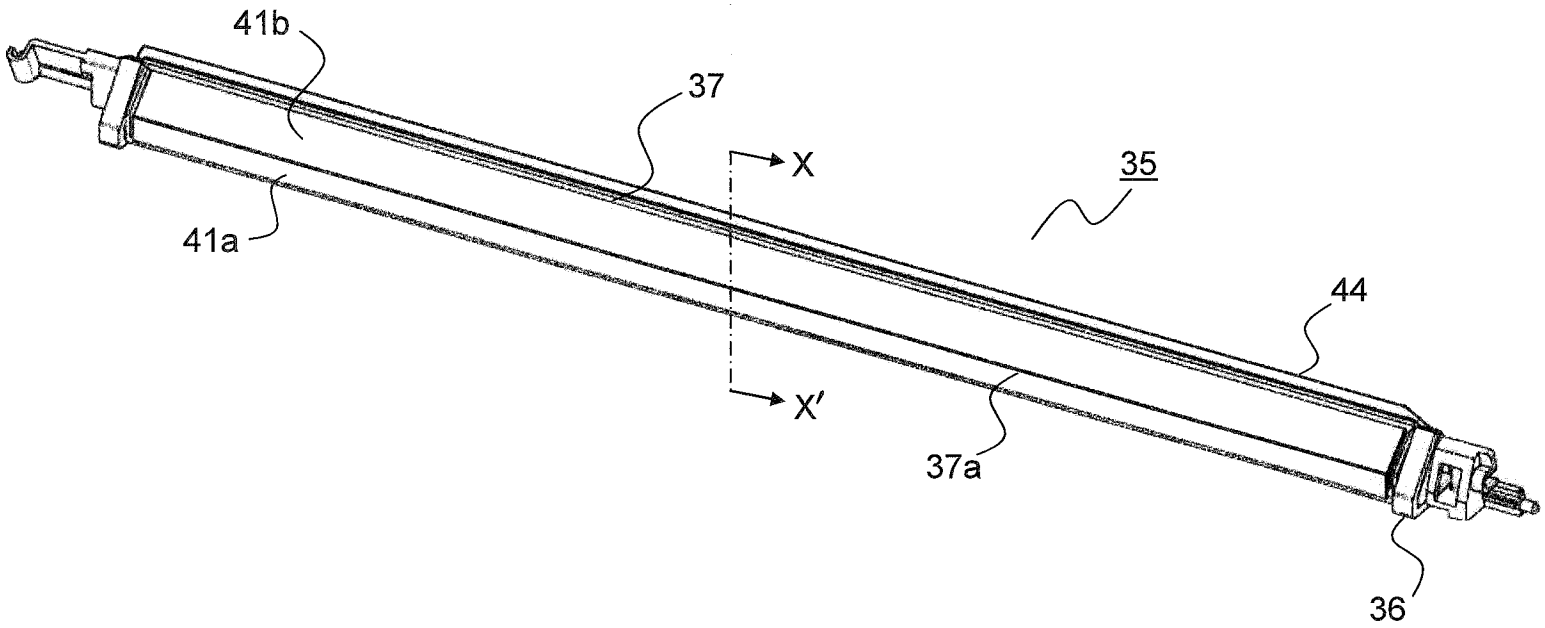
FIG. 3 is a perspective view of a toner receiver support member 35 used in the developing device 3*a* of the present embodiment, as seen from inside a developing container 20.
Figure 4:
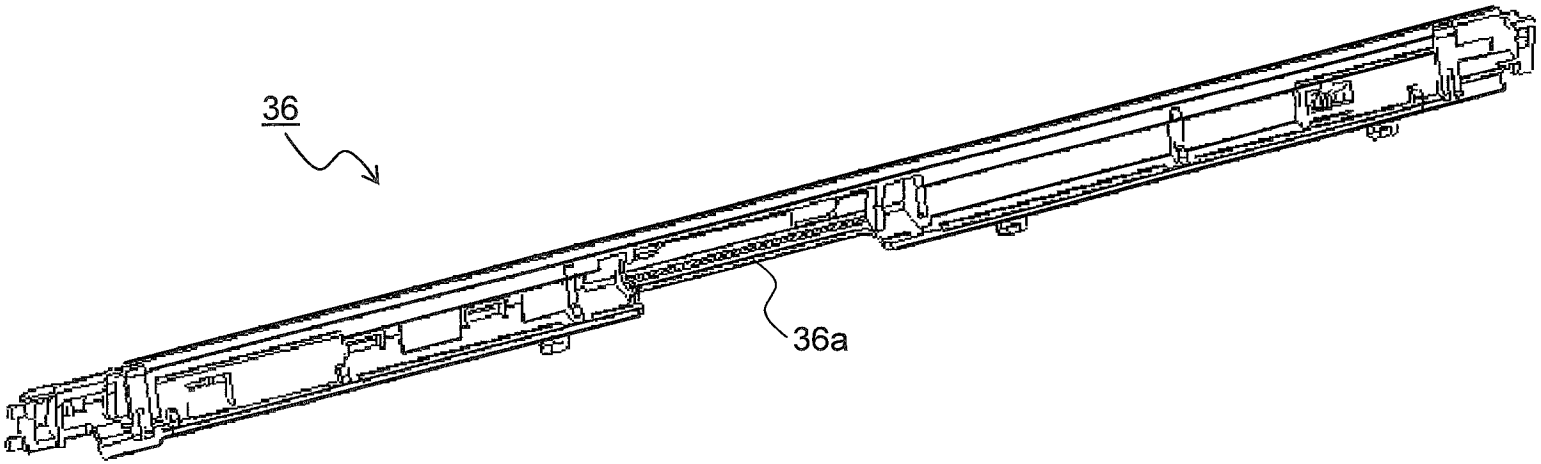
FIG. 4 is a perspective view of a support member main body 36 included in the toner receiver support member 35.
Figure 5:
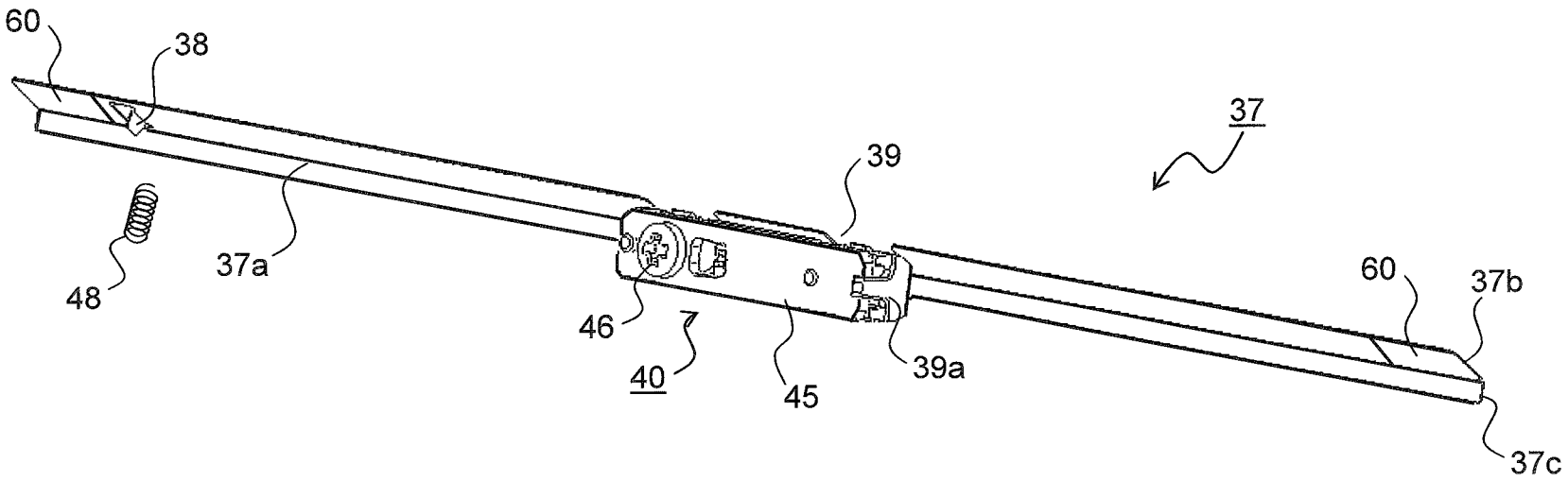
FIG. 5 is a perspective view of a toner receiver member 37 to be attached to the toner receiver support member 35, as seen from a back side.

FIG. 3 is a perspective view of the toner receiver support member 35, which is used in the developing devices 3*a* to 3*d* of the present embodiment, as seen from the inside of the developing container 20 (a left side of FIG. 2), FIG. 4 is a perspective view of a support member main body 36 included in the toner receiver support member 35, and FIG. 5 is a perspective view of the toner receiver member 37 to be attached to the toner receiver support member 35 as seen from the inside of the toner receiver support member 35. Note that FIG. 4 illustrates the support member main body 36 as seen from an attachment direction of the toner receiver member 37.

The toner receiver support member 35 has the support member main body 36 made of resin, the toner receiver member 37 made of sheet metal and swingably supported by the support member main body 36, and a vibration generator 40 attached to a substantially center part of the toner receiver member 37 in its longitudinal direction. In the support member main body 36, there is formed an accommodation portion 36*a* in which the vibration generator 40 is accommodated when the toner receiver member 37 is attached to the support member main body 36.

Further, at an upper end of the support member main body 36, there is provided a seal member 44 that has a film-like shape. The seal member 44 extends in a longitudinal direction of the support member main body 36 (a right-left direction in FIG. 3) such that an end part of the seal member 44 is in contact with a surface of the photosensitive drum 1*a*. The seal member 44 has a function as a shield to prevent the toner inside the developing container 20 (see FIG. 2) from leaking to the outside.

The toner receiver member 37 has a bent shape such that a bent portion 37*a* is formed along its longitudinal direction. The toner receiver member 37 is divided into a toner receiving surface 37*b* that faces the developing roller 31 (see FIG. 2) and a toner fall surface 37*c* that is substantially vertical and faces the toner supplying roller 30, with the bent portion 37*a* between the toner receiving surface 37*b* and the toner fall surface 37*c*. On one end side of the toner receiver member 37 in its longitudinal direction, there is formed an engagement portion 38 to which is engaged a contact spring 48 via which the toner receiver member 37 is grounded. A lower end part of the contact spring 48 contacts the trimming blade 33 (see FIG. 2) via an electrically conductive spring receiver member (not shown). At a substantially center part of the toner receiver member 37 in its longitudinal direction, there is formed a holding portion 39 that has a pair of holding claws 39*a* for holding the vibration generator 40. A base 45 is fixed to the vibration generator 40 with a screw 46, and on the base 45, there are mounted a circuit for controlling driving of a vibration motor 43 (see FIG. 6) and electronic components (not shown).

Sheet members 41*a* and 41*b* are bonded to surfaces (a surface facing the developing roller 31 and a surface facing the toner supplying roller 30) of the toner receiver member 37. In order to reduce adhesion of toner to the toner receiver member 37, the sheet members 41*a* and 41*b* are made of a material that is less prone to toner adhesion than a material of the toner receiver member 37. Examples of the material for the sheet members 41*a* and 41*b* include a fluororesin sheet, for example.

At each end part of the toner receiving surface 37*b* in its longitudinal direction, there is formed a thin-walled portion 60 that is thinner in thickness than other parts of the toner receiving surface 37*b*. A detailed description will be given later of the thin-walled portion 60.

Figure 6:
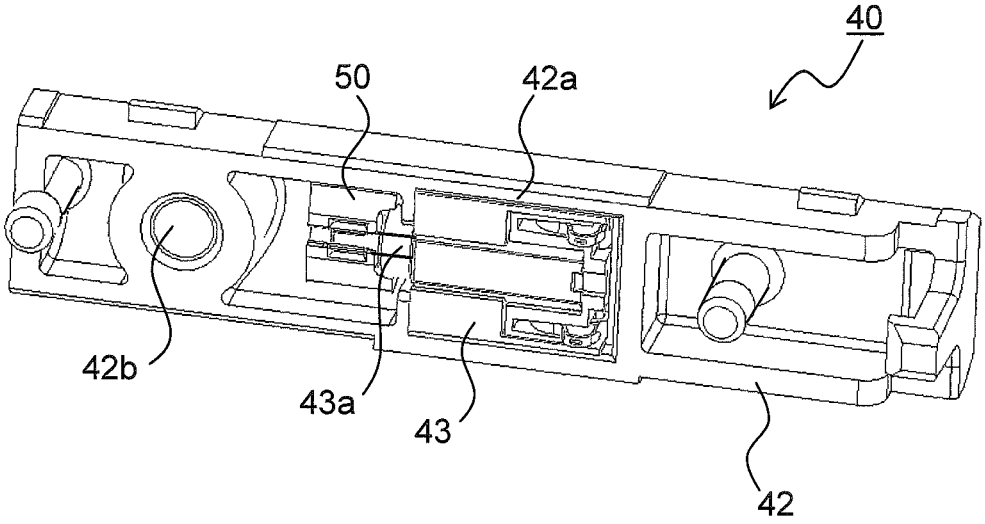
FIG. 6 is a perspective view of an internal structure of a vibration generator 40 to be attached to the toner receiver member 37.

FIG. 6 is a perspective view of the vibration generator 40. Note that FIG. 6 shows a state where the base 45 (see FIG. 5) has been removed from a motor mounting holder 42 so that an inside of the vibration generator 40 can be seen. The vibration generator 40 includes the motor mounting holder 42 and the vibration motor 43. In the motor mounting holder 42, there are formed a motor holding portion 42*a* that holds the vibration motor 43 and a screw hole 42*b* into which the screw 46 is to be screwed. An oscillating weight 50 is fixed to an output shaft 43*a* of the vibration motor 43. When the vibration generator 40 is attached to the toner receiver member 37, it is fixed such that the output shaft 43*a* of the vibration motor 43 lies along the longitudinal direction of the toner receiver member 37. Further, to the motor mounting holder 42, there is connected a lead wire (not shown) for supplying electric power to the vibration motor 43.

Figure 7:
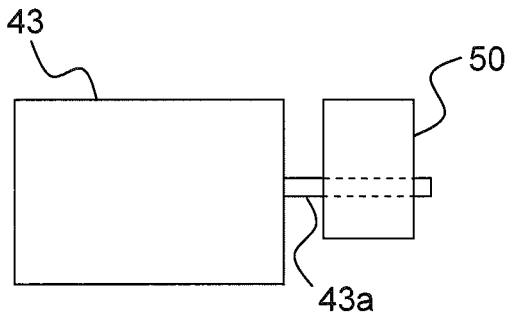
FIG. 7 is a front view of a vibration motor 43.
Figure 8:
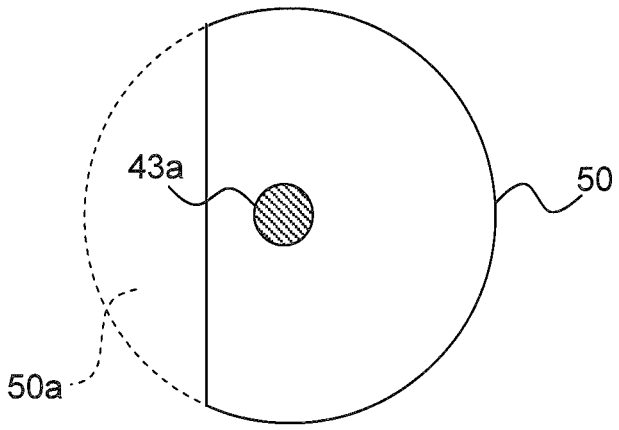
FIG. 8 is a side view of the vibration motor 43 as seen from an oscillating-weight-50 side.

FIG. 7 is a front view of the vibration motor 43, and FIG. 8 is a side view of the vibration motor 43 as seen from a side on which the oscillating weight 50 is disposed. As seen from a direction of the output shaft 43*a* of the vibration motor 43 (from a right side in FIG. 7), as illustrated in FIG. 8, the oscillating weight 50 is formed in a cam-like shape with a cut portion 50*a* formed in part of a disc shape, and is asymmetric with respect to the output shaft 43*a*. When the output shaft 43*a* rotates at a predetermined speed or faster, a smaller centrifugal force acts on the cut portion 50*a* than on other parts, and thus an uneven centrifugal force is applied to the oscillating weight 50. The uneven centrifugal force is transmitted to the output shaft 43*a* to cause the vibration motor 43 to vibrate. The shape of the oscillating weight 50 is not limited to the cam-like shape, but any shape may be adopted as long as a center of gravity of the oscillating weight 50 can be shifted with respect to the output shaft 43*a*.

Figure 9:
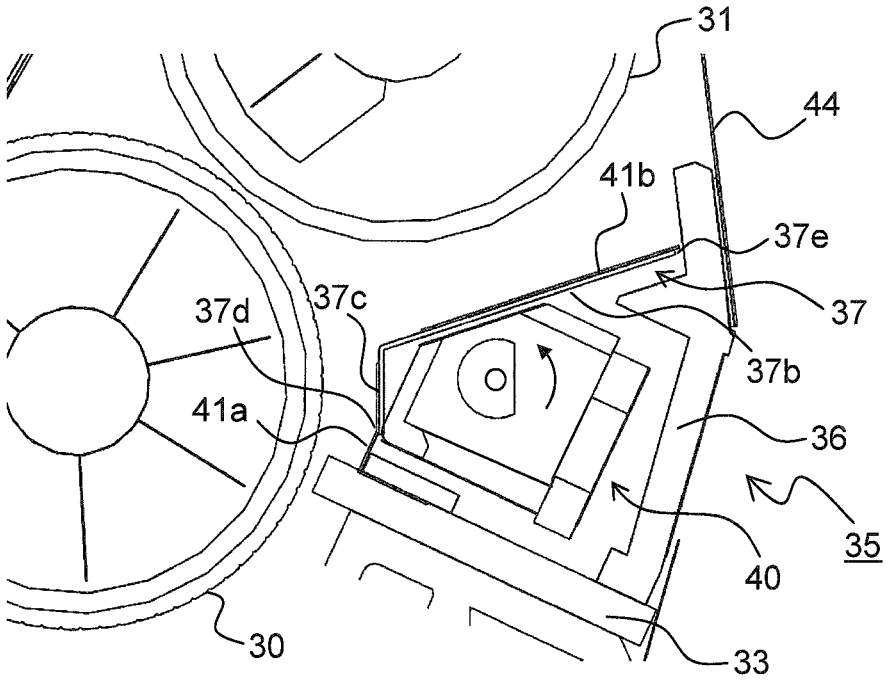
FIG. 9 is a side sectional view of and around the toner receiver support member 35 of the developing device 3*a* of the present embodiment, showing a cross-section of the vibration motor 43 and a surrounding area.
Figure 10:
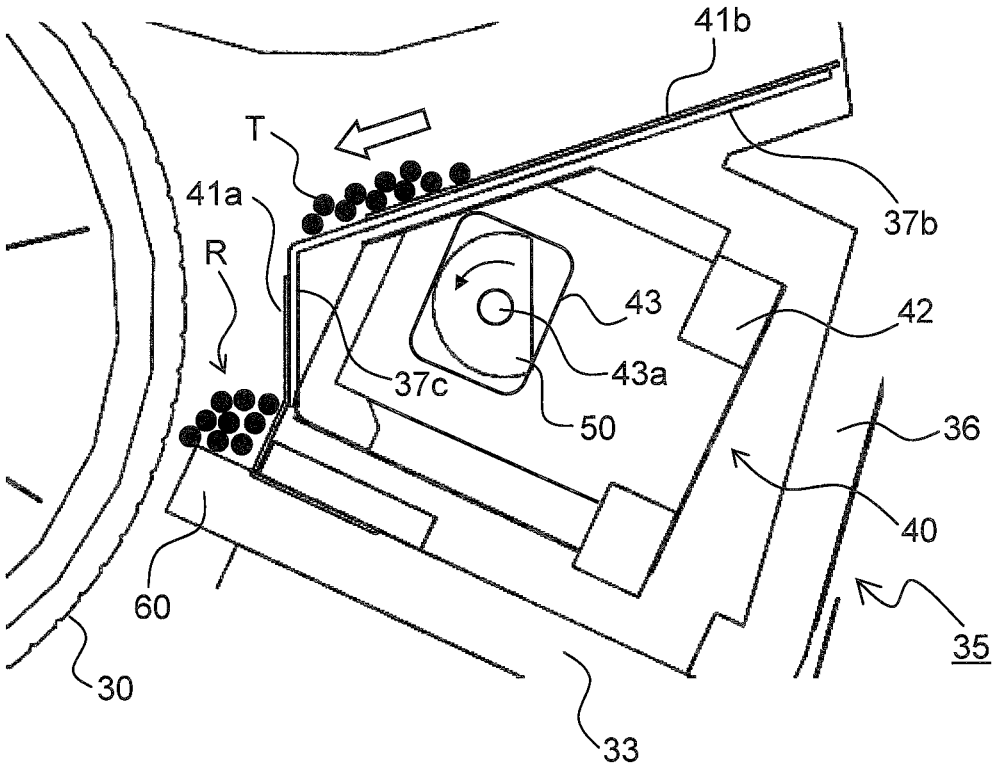
FIG. 10 is an enlarged view of a part of the toner receiver support member 35 illustrated in FIG. 9.

FIG. 9 is a side sectional view (taken along line XX' in FIG. 3) showing, in section, a structure of, and around, the vibration motor 43 for the toner receiver support member 35 used in the developing device 3*a* of the present embodiment, and FIG. 10 is an enlarged view of a part of the toner receiver support member 35 illustrated in FIG. 9.

As illustrated in FIG. 9 and FIG. 10, the toner receiver member 37 has only an edge 37*d* on a toner-supplying-roller-30 side in contact with the support member main body 36, and an edge 37*e* on an opposite side (a photosensitive-drum-1*a* side) is a free end. And a substantially center part of the toner receiving surface 37*b* in its width direction (a right-left direction in FIG. 9) is supported by the support member main body 36 via the vibration generator 40. Thereby, the toner receiver member 37 is configured to be swingable about the edge 37*d* as a fulcrum. The vibration motor 43 is disposed such that the output shaft 43*a* is substantially parallel to the longitudinal direction of the toner receiver member 37.

The toner receiver member 37 is disposed such that the toner receiving surface 37*b* facing the developing roller 31 is so inclined as to rise from the toner-supplying-roller-30 side toward the photosensitive-drum-1*a* side, and the toner fall surface 37*c* facing the toner supplying roller 30 is substantially vertical.

The sheet member 41*a* is bonded so as to cover a surface (the toner fall surface 37*c*) of the toner receiver member 37, including a trimming-blade-33 side boundary between the support member main body 36 and the toner receiver member 37. Further, the sheet member 41*b* is bonded to entirely cover the toner receiving surface 37*b*, including a seal-member-44 side boundary between the support member main body 36 and the toner receiver member 37, the engagement portion 38, and the holding portion 39 (see FIG. 5). The sheet members 41*a* and 41*b* reduce adhesion of toner to the toner receiving surface 37*b* and the toner fall surface 37*c*, and also prevent leakage of toner through the boundaries between the toner receiver support member 35 and the toner receiver member 37, entry of toner to an inside of the toner receiver support member 35, and operation defect of the vibration motor 43 caused by the entry of toner.

By rotating the output shaft 43*a* at high speed (for example, approximately 10,000 rpm) during non-image formation when no image is being formed, the oscillating weight 50 is also rotated at high speed together with the output shaft 43*a*. At this time, an uneven centrifugal force is applied to the oscillating weight 50, and thus the vibration motor 43 and the motor mounting holder 42 vibrate via the output shaft 43*a*. As a result, the toner receiver member 37 to which the vibration generator 40 is attached also vibrates. Specifically, the toner receiving surface 37*b* of the toner receiver member 37 vibrates about the edge 37*d* as a fulcrum such that an amplitude of the vibration is larger toward the edge 37*e*.

In the present embodiment, the output shaft 43*a* of the vibration motor 43 is rotated in a direction (a counterclockwise direction in FIG. 10) in which such part of an outer circumferential surface of the output shaft 43*a* as faces the toner receiver member 37 moves from the free end (the edge 37*e*) of the toner receiver member 37 toward the fulcrum (the edge 37*d*). By the rotation of the output shaft 43*a* in this direction, the toner receiver member 37 is vibrated and thereby causes toner accumulated on the toner receiving surface 37*b* to move from an edge-37*e* side to an edge-37*d* side.

On the other hand, if the output shaft 43*a* is rotated in a reverse direction (a clockwise direction in FIG. 10), the vibration of the toner receiver member 37 causes the toner particles to move in such a manner as to rise from the edge-37*d* side to the edge-37*e* side, and thus the toner accumulated on the toner receiving surface 37*b* does not slide down along the toner receiving surface 37*b*. Thus, by rotating the output shaft 43*a* of the vibration motor 43 in the manner as in the present embodiment, it is possible to allow the toner particles accumulated on the toner receiving surface 37*b* to effectively fall along the downward slope into a region R.

As illustrated in FIG. 10, vibration of the toner receiving surface 37*b* causes toner T accumulated on the toner receiving surface 37*b* to slide downward (in a direction indicated by a white arrow in FIG. 10) along the slope of the toner receiving surface 37*b*. Toner that has slid down and off from the toner receiving surface 37*b* to freely falls into the region R between the substantially vertical toner fall surface 37*c* and the toner feeding roller 30.

Figure 11:
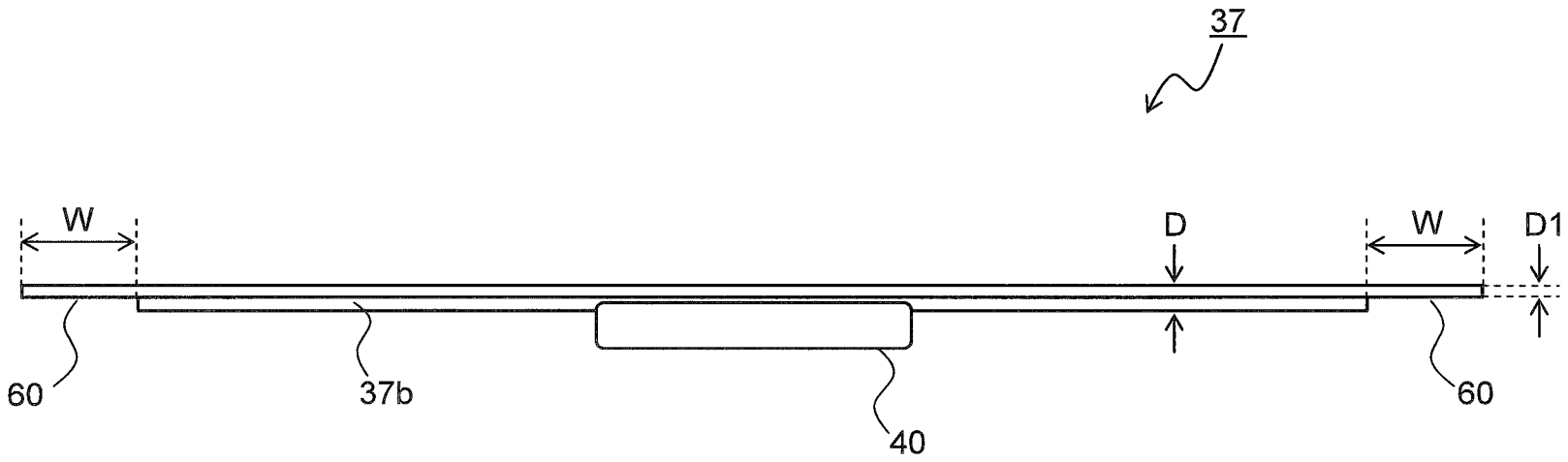
FIG. 11 is a side view of a toner receiving surface 37*b* of the toner receiver member 37 as seen from a direction perpendicular to a longitudinal direction of the toner receiver member 37.

FIG. 11 is a side view of the toner receiving surface 37*b* of the toner receiver member 37 as seen from a direction perpendicular to the longitudinal direction of the toner receiver member 37. As illustrated in FIG. 11, the thin-walled portion 60 is formed such that a step is formed on a back side (a side facing the toner receiver support member 35, a lower side as seen in FIG. 11) of the toner receiving surface 37*b*.

The thin-walled portion 60 is lighter-weighted and smaller in flexural rigidity than other parts of the toner receiving surface 37*b*, and thus each end part of the toner receiver member 37 in its longitudinal direction where the thin-walled portion 60 is formed vibrates with a relatively larger amplitude as compared with a center part of the toner receiver member 37. Thus, even when a large amount of toner has accumulated at each end part of the toner receiving surface 37*b* in its longitudinal direction, the vibration of the thin-walled portion 60 causes the toner accumulated on each end part of the toner to jump and efficiently move to the edge-37*d* side.

Thus, even in a case where a small motor that generates a small amount of vibration is used as the vibration motor 43, it is possible to secure vibration sufficient to cause toner particles accumulated over an entire area of the toner receiver member 37 in its longitudinal direction to fall. Thereby, it is possible to improve compactness of the developing devices 3*a* to 3*d* and the image forming apparatus 100 while effectively reducing occurrence of image defects caused by fallen toner.

Further, by forming the thin-walled portion so as to form a step on the back side of the toner receiving surface 37*b*, it is possible to form a front side (a side facing the developing roller 31, that is, an upper side as seen in FIG. 11) of the toner receiving surface 37*b* in a flat shape that allows toner to easily move thereon under vibration.

A width W of the thin-walled portion 60 in the longitudinal direction of the toner receiving surface 37*b* may be appropriately changed according to an amount of toner that accumulates on the toner receiving surface 37*b*. In the present embodiment, since a large amount of toner accumulates at each end part of the toner receiving surface 37*b* in its longitudinal direction, in an area having a length of about 1.5 cm inward from each end, and thus the width W of the thin-walled portion 60 in the longitudinal direction of the toner receiving surface 37*b* is set to 1.5 cm.

Examples of methods for forming the thin-walled portion 60 in the toner receiver member 37 include a method in which two metal sheets different from each other in dimension in a longitudinal direction are bonded together such that a thin-walled portion is formed at each end part. When the two metal sheets have a same thickness, then the thin-walled portion 60 has a thickness D1 that is half a thickness D of other parts. With this method, the thin-walled portion 60 can be easily formed with any of various thicknesses just by selecting a thickness of the metal sheets.

Part of the toner that has fallen from the toner receiving surface 37*b* to accumulate in the region R adheres to the magnetic brush formed on the toner supplying roller 30. To deal with this, during non-image formation, the developing roller 31 and the toner supplying roller 30 are rotated (forwardly rotated) in a direction same as a direction (the counterclockwise direction in FIG. 9) in which they are rotated during image formation. By forwardly rotating the toner supplying roller 30, the toner adhered to the magnetic brush on the toner supplying roller 30 rotates together with the magnetic brush along with the rotation of the toner supplying roller 30, is peeled off from the toner supplying roller 30 at the homopolar portion of the stationary magnet body, and then falls into the supply-conveyance chamber 22.

Here, when the developing roller 31 and the toner supplying roller 30 are forwardly rotated, part of the toner adhered to the magnetic brush on the toner supplying roller 30 moves onto the developing roller 31. However, Vslv(DC) is not applied to the developing roller 31 during non-image formation, and thus potential difference between the developing roller 31 and the photosensitive drum 1*a* is zero. Accordingly, there is no possibility for the toner to move to the photosensitive-drum-1*a* side even when the toner adhered to the surface of the developing roller 31 is caused, by the rotation of the developing roller 31, to pass through the opposing portion of the developing roller 31 and the photosensitive drum 1*a*.

Further, when vibrating the toner receiver member 37, Vslv(DC) having the same polarity as the toner has may be applied to the developing roller 31, without applying Vmag (DC) to the toner supplying roller 30. In this way, a potential difference is generated in a direction in which the toner moves from the developing roller 31 to the toner supplying roller 30, and this helps effectively reduce occurrence of a phenomenon in which toner shaken off from the toner receiver member 37 to adhere to the toner supplying roller 30 moves to the developing roller 31.

Incidentally, for the purpose of returning the toner fallen into the region R to the supply-conveyance chamber 22, it is also possible to rotate (reversely rotate) the developing roller 31 and the toner supplying roller 30 during non-image formation in a direction (the clockwise direction in FIG. 10) reverse to the direction in which they are rotated during image formation. By reversely rotating the toner supplying roller 30, the toner fallen into the region R and accumulated on an end of the trimming blade 33 is scraped off by the magnetic bush formed on the toner supplying roller 30. The toner scraped off in this manner rotates together with the surface of the toner supplying roller 30 to pass through a gap between the toner supplying roller 30 and the trimming blade 33, and is peeled off from the toner supplying roller 30 at the homopolar portion of the stationary magnet body, to be then forcibly returned to the supply-conveyance chamber 22.

In the case where the developing roller 31 and the toner supplying roller 30 are reversely rotated, it is possible to scrape off the toner accumulated on the end of the trimming blade 33 more effectively by so adjusting magnetic force and disposition of the magnetic poles (regulation poles) in the stationary magnet body facing the trimming blade 33 as to allow bristles of the magnetic brush formed on the toner supplying roller 30 to be long. Further, as has been mentioned above, there is a possibility that the reverse rotation of the developing roller 31 and the toner supplying roller 30 may be accompanied by leakage of the developer from inside the developing container 20 through the toner replenishment port, or noise of the toner concentration detection sensor 27 generated when the developer is maldistributed inside the developing container 20. To address these, it is preferable to forwardly rotate the developing roller 31 and the toner supplying roller 30 for a predetermined time after reversely rotating the developing roller 31 and the toner supplying roller 30.

As for a timing for vibrating the toner receiver member 37, the vibration may be performed each time a printing operation is completed, or may be performed at a predetermined timing such as each time printing has been performed on a predetermined number of sheets or each time temperature of inside the developing device 3*a* reaches or exceeds a predetermined temperature. Further, the timing of vibrating the toner receiver member 37 and the timing of forwardly (or reversely) rotating the developing roller 31 and the toner supplying roller 30 may be the same or different. Further, by vibrating the toner receiver member 37 each time printing has been performed on a predetermined number of sheets, the toner receiver member 37 is automatically vibrated in accordance with the number of sheets printed. This accordingly eliminates need for users themselves to manually perform settings for the vibration of the toner receiver member 37, and thus helps avoid erroneous setting, omission of setting, or performance of unnecessary vibration.

It should be understood that the present disclosure is not limited to the above embodiments, and various modifications are possible within the scope of the present disclosure. For example, the shapes and configurations of the toner receiver support member 35 and the toner receiver member 37 of the above-described embodiments are merely examples, and are not particularly meant to limit the present disclosure. The shapes and configurations may be appropriately set in accordance with factors including apparatus configurations.

Figure 12:
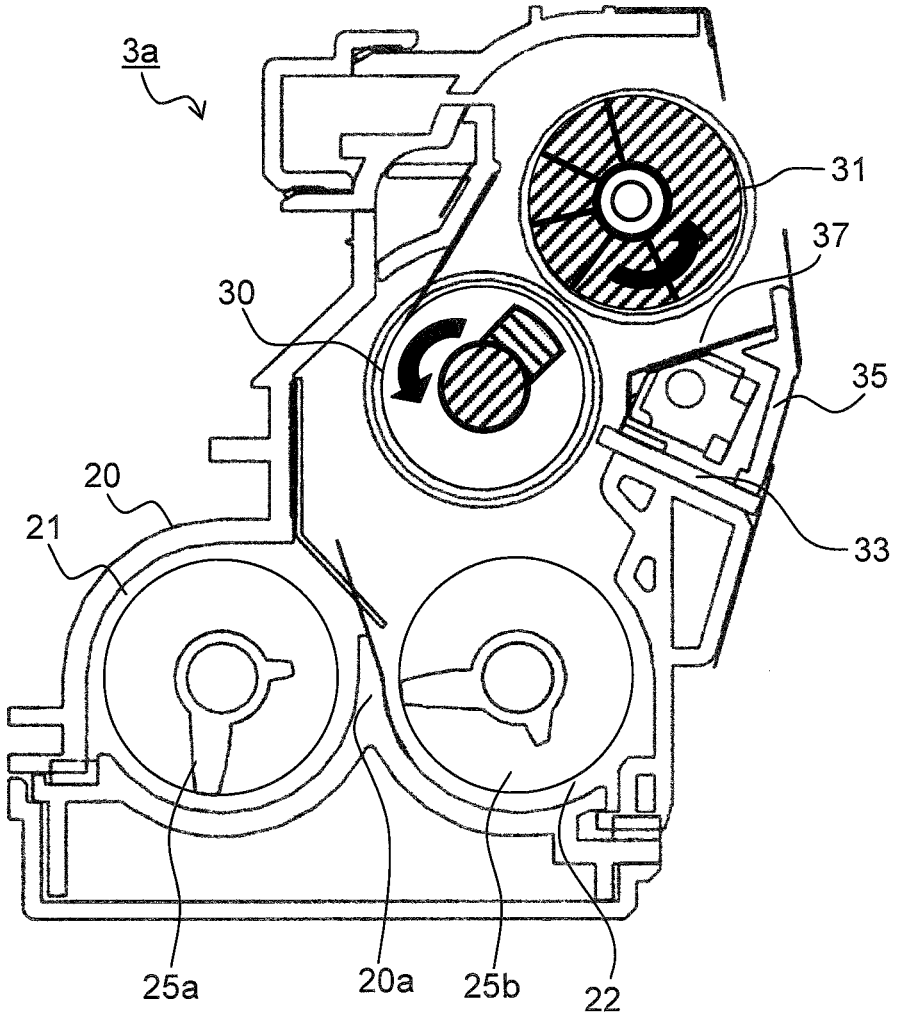
FIG. 12 is a side sectional view of the developing device 3*a* of the present disclosure with a toner supplying roller 30 and a developing roller 31 disposed in a reversed arrangement.

In the above embodiments, the present disclosure is applied to the developing devices 3*a* to 3*d* that each use two-component developer, each form a magnetic brush on the toner supplying roller 30, each move only toner from the toner supplying roller 30 to the developing roller 31, and each supply the toner from the developing roller 31 to a corresponding one of photosensitive drums 1*a* to 1*d*; however, it is also possible to apply the present disclosure to a developing device in which the disposition of the developing roller 31 and the toner supplying roller 30 is opposite to that in the above embodiments as illustrated in FIG. 12. In this developing device, toner is supplied to each of the photosensitive drums 1*a* to 1*d* by means of a magnetic brush formed of the two-component developer and held on the surface of the developing roller 31 (which, in the present configuration, is a magnetic roller similar to the toner supplying roller 30 in the above embodiments). Then, toner held on the surface of the toner supplying roller 30 (which, in the present configuration, is configured similar to the developing roller 31 of the above embodiments) is supplied to the developing roller 31, and excessive toner remaining on the surface of the developing roller 31 is collected by means of the toner supplying roller 30. With this configuration, too, it is possible to effectively reduce an amount of toner fallen from the developing roller 31 and accumulating around the regulation blade 33 facing the toner supplying roller 30. Hereinafter, the effects of the present disclosure will be described more specifically using examples of the present disclosure.

EXAMPLES

A study was conducted with respect to difference in vibration of the toner receiver member 37 in its longitudinal direction between cases with and without the thin-walled portion 60. In the experiments, vibration wave forms (amplitudes) were measured by using a developing device 3*a* of the present embodiment (the present disclosure) having a thin-walled portion 60 formed at each end part of a toner receiver member 37 in the longitudinal direction as illustrated in FIG. 11, and a developing device 3*a* (comparative example) having the same configuration as in the present disclosure except that no thin-walled portion 60 is provided, and by changing the position of the toner receiver member 37 in the longitudinal direction.

The toner receiver members 37 were prepared by bonding two stainless-steel sheets both having a thickness of 0.1 mm. Each of the toner receiver members 37 was 317 mm long, and had a toner receiving surface 37*b* with a width of 12.7 mm and a thickness of 0.2 mm. In the developing device 3*a* of the present disclosure, in an area extending inward by 1.5 cm from each end of the toner receiving surface 37*b* in the longitudinal direction, a 0.1 mm-thick thin-walled portion 60 was formed where the stainless-steel sheets were not superposed on each other.

A motor with a rated speed of 10000±3000 rpm, a rated voltage of 3.0 V (a rated voltage range of 2.6 to 3.6 V), a rated current of 160 mA, and a starting current of 175 mA was used as a vibration motor 43. Further, to a rotation shaft 43*a* of the vibration motor 43, a weight made of a tungsten alloy in a semicircular-prism shape having a length of 3.6 mm and a bottom surface semicircular with a diameter of 3 mm and a central angle of 150° (having a volume of 42.39 mm3 and a mass of 0.838 g). The measurement results are shown in FIG. 13.

Figure 13:
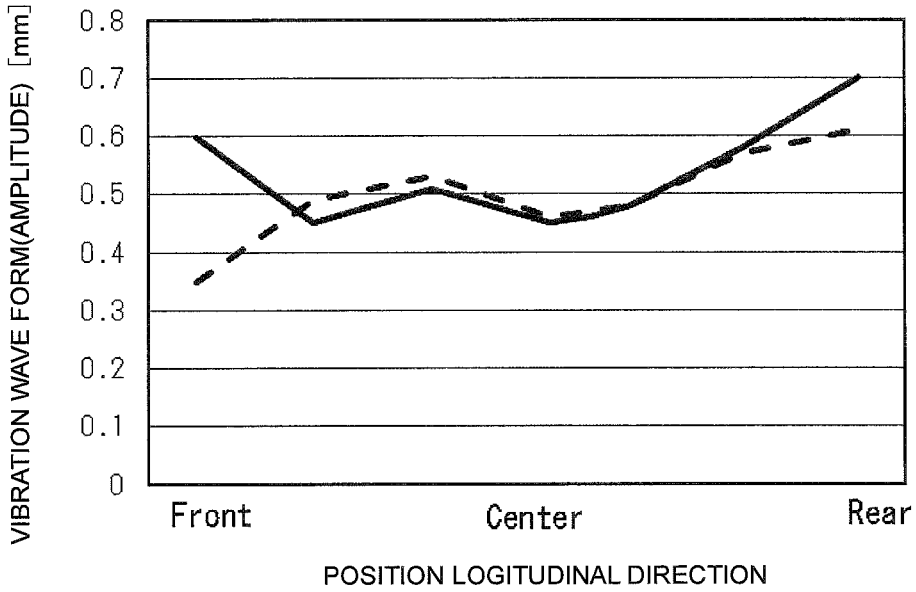
FIG. 13 is a graph for comparison in amplitude variation in the longitudinal direction of the toner receiver member 37 between in a case where a thin-walled portion 60 is provided (the present disclosure) and in a case where the thin-walled portion 60 is not provided (a comparative example).

As illustrated in FIG. 13, with the developing device 3*a* of the present disclosure provided with the thin-walled portion 60 at each end part of the toner receiving surface 37*b* (indicated by a solid line in FIG. 13), the amplitude was 0.6 mm at one end part (the thin-walled portion 60 on the front side) in the longitudinal direction of the toner receiver member 37, about 0.45 mm to 0.55 mm at a center part in the longitudinal direction (at a position 150 to 160 mm inward from one end part), and 0.7 mm at the other end part (the thin-walled portion 60 on the rear side) in the longitudinal direction.

In contrast, with the developing device 3*a* of the comparative example that was not provided with a thin-walled portion 60 (indicated by a broken line in FIG. 13), the amplitude was 0.35 mm at one end part (on the front side) in the longitudinal direction of the toner receiver member 37, about 0.45 mm to 0.55 mm at a center part in the longitudinal direction (at a position 150 to 160 mm inward from one end part), and 0.6 mm at the other end part (on the rear side) in the longitudinal direction, and thus was smaller than in the present disclosure at each end part in the longitudinal direction. The above results have confirmed that, in the developing device 3*a* of the present disclosure, the amplitude at each end part of the toner receiver member 37 in its longitudinal direction is increased as compared with that of the comparative example, and that the developing device 3*a* of the present disclosure is advantageous in effectively shaking off toner accumulated at each end part in the longitudinal direction.

The present disclosure is applicable to a developing device having a toner receiver member that faces a developing roller between a regulation blade and an opposing region of an image carrier and the developing roller. With use of the present disclosure, it is possible to provide a developing device capable of improving performance of recovering toner accumulated at each end part of a toner receiver member in a longitudinal direction thereof with a simple configuration, and an image forming apparatus provided with such a developing device.

What is claimed is:

1. A developing device comprising:

a developing roller that is disposed to face an image carrier on which an electrostatic latent image is formed, the developing roller being configured to supply toner to the image carrier in an opposing region where the developing roller and the image carrier face each other;

a toner supplying roller that is disposed to face the developing roller, the toner supplying roller being configured to supply toner to the developing roller in an opposing region where the toner supplying roller and the developing roller face each other;

a regulation blade that is disposed to face the toner supplying roller with a predetermined space therebetween;

a casing that accommodates the developing roller, the toner supplying roller, and the regulation blade;

a toner receiver support member that is disposed inside the casing so as to face the developing roller or the toner supplying roller between the regulation blade and the image carrier;

a toner receiver member that is disposed along a longitudinal direction of the toner receiver support member, the toner receiver member having a toner receiving surface that receives toner falling from the developing roller, and a thin-walled portion that is formed at each end part of the toner receiving surface in a longitudinal direction thereof and is thinner in thickness than other parts of the toner receiving surface; and a vibration generator that vibrates the toner receiver member.

2. The developing device according to claim 1, wherein the thin-walled portion is formed such that a step is formed on a side of the toner receiving surface opposite to a side of the toner receiving surface that faces the developing roller.

3. The developing device according to claim 1, wherein the toner receiving surface is formed of two metal sheets different from each other in dimension in a longitudinal direction, the two metal sheets being bonded together such that, at each end part of the toner receiving surface, the thin-walled portion is formed in which the two metal sheets are not superposed on each other.

4. The developing device according to claim 1, wherein during non-image formation, the toner receiver member is vibrated by the vibration generator, and the developing roller and the toner supplying roller are each rotated in a same direction as during image formation.

5. The developing device according to claim 4, wherein when vibrating the toner receiver member, a direct current voltage having a same polarity as toner has is applied to the developing roller without applying a direct current voltage to the toner supplying roller.

6. The developing device according to claim 1, wherein the vibration generator comprises a vibration motor fixed to a back surface of the toner receiver member, and an oscillating weight fixed to an output shaft of the vibration motor such that a center of gravity of the oscillating weight is shifted with respect to the output shaft.

7. The developing device according to claim 6, wherein the vibration motor is fixed to the back surface of the toner receiver member such that the output shaft is substantially parallel to a longitudinal direction of the toner receiver member, the toner receiver member is swingably supported with a said-toner-supplying-roller-side edge thereof as a fulcrum, and with a said-image-carrier-side edge thereof as a free end, and the output shaft of the vibration motor is rotated in a direction in which such part of an outer circumferential surface of the output shaft as faces the toner receiver member moves from a said-free-end side toward a said-fulcrum side of the toner receiver member.

8. The developing device according to claim 1, wherein the toner receiver member includes a sheet member bonded to a surface thereof that faces the developing roller or a surface thereof that faces the toner supplying roller, the sheet member having toner adhesiveness lower than toner adhesiveness of the toner receiver member.

9. The developing device according to claim 1, wherein the toner supplying roller is a magnetic roller that carries a two-component developer containing toner and carrier by means of a plurality of magnetic poles provided inside the toner supplying roller.

10. The developing device according to claim 1, wherein the developing roller is a magnetic roller that carries a two-component developer containing toner and carrier by means of a plurality of magnetic poles provided inside the developing roller.

11. An image forming apparatus comprising the developing device according to claim 1.

* * * * *